US007245734B2

(12) United States Patent
Niederdraenk

(10) Patent No.: US 7,245,734 B2
(45) Date of Patent: Jul. 17, 2007

(54) DIRECTIONAL MICROPHONE

(75) Inventor: Torsten Niederdraenk, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 472 days.

(21) Appl. No.: 10/757,842

(22) Filed: Jan. 15, 2004

(65) Prior Publication Data

US 2005/0084128 A1 Apr. 21, 2005

(30) Foreign Application Priority Data

Apr. 9, 2003 (DE) ..... 103 16 287

(51) Int. Cl.
*H04R 9/08* (2006.01)

(52) U.S. Cl. ..... 381/356; 381/313

(58) Field of Classification Search ..... 381/355–358
See application file for complete search history.

(56) References Cited

U.S. PATENT DOCUMENTS 4,504,703 A * 3/1985 Schneiter et al. ..... 381/163
4,974,117 A 11/1990 Irwin
5,524,056 A * 6/1996 Killion et al. ..... 381/314

OTHER PUBLICATIONS

Variable directivity capacitor microphone, Yoshio et al.; Published Japanese Patent Application (Published Jun. 2, 1995). Retrieved Jun. 22, 2006 <retrieved from http://www.jpo.go.jp>. 1 page of abstract, 11 pages of machine translation and 6 pages of drawings.*

Mechanically coupled ears for directional hearing in the parasitoid fly *Ormia ochracea*, R.N. Miles, Dec. 1995 Acoustical Society of America, 3059-3070.

* cited by examiner

*Primary Examiner*—Sinh Tran
*Assistant Examiner*—Walter F Briney, III
(74) *Attorney, Agent, or Firm*—Schiff Hardin LLP

(57) ABSTRACT

A directional microphone system comprises two membranes that, on the one hand, are respectively acoustically connected via an air volume with one of two spatially separate sound entrance ports, and on the other hand are acoustically coupled with one another via a third air volume, as well as an output generator configured to generate at least one output signal of the directional microphone from the vibration of one of the two membranes.

12 Claims, 2 Drawing Sheets

DIRECTIONAL MICROPHONE

BACKGROUND OF THE INVENTION

The invention concerns a directional microphone.

Modern hearing devices resort to directional microphone arrangements that, via their direction-dependent microphone sensitivity, enable an exclusion of unwanted signals coming from lateral and backwards directions. This spatial effect improves the wanted-signal-to-background-noise ratio, such that, for example, an increased speech comprehension of the wanted signal exists. The conventional directional microphone arrangements are based on an evaluation of the phase (delay) differences that result given a spreading sound wave between at least two spatially separate sound acquisition locations.

In hearing devices, until now, gradient microphones or, respectively, directional microphone arrangements of a first and higher order, comprising a plurality of omnidirectional acoustic pressure sensors, have been used for this. While the first determines the difference (stemming from the mechanical assembly) of the sound signals originating from two sound entrance ports, a good static or even adaptively variable directional effect can be achieved via suitable signal processing, given a combination of a plurality of acoustic pressure sensors.

However, all known methods evaluate the differences of the sound signals present at the sound entrance ports in the same manner. Since the distances between the sound entrance ports in hearing device applications are very small (conditional upon the type), this leads to the fact that, given deeper frequencies at which the sound wavelength is much larger than the separation of the microphone entrance ports, the differences to be determined between the audio signals, and thus also the directional effect to be achieved, are very small. Typically, all directional microphone arrangements possess a clearly reduced directional effect at lower frequencies; moreover, arrangements made up of a plurality of pressure sensors place very high demands on the amplitude and phase compensation of the microphones.

A differential pressure transducer is known from U.S. Pat. No. 4,974,117 that capacitively couples two membranes, where the pressure difference is measured between the pressure in the volume between the membranes and the pressure in the volume that surrounds both membranes.

In imitation of the acoustic organ of the "Ormia" fly, which achieves a unique directional effect with the aid of a mechanical coupling of two auditory membranes, various approaches to use mechanically coupled auditory membranes in hearing aid devices have been pursued. For example, in a microphone system based on silicon micromechanics, the vibration-capable membrane of two independent microphones arranged adjacent to one another are negatively coupled with one another via a web (see "Mechanically Coupled Ears for Directional Hearing in the Parasitoid Fly Ormia Ochracea", R. N. Miles, D. Robert, R. R. Hoy, Journal of the Acoustical Society of America 98 (1995), pg. 3059).

SUMMARY OF THE INVENTION

The invention is based on the object of providing a directional microphone, as well as the use of a directional microphone in a hearing aid device, that lead to a good directional effect given the smallest possible structural shape.

The first cited object is achieved by a directional microphone with: two membranes that, on the one hand, are respectively acoustically connected via an air volume with one of two spatially separate sound entrance ports, and on the other hand are acoustically coupled with one another via a third air volume; and with a mechanism to generate at least one output signal of the directional microphone from the vibration of one of the two membranes.

The increased directional resolution of a directional microphone according to embodiments of the invention is achieved via the acoustic coupling of two independent membranes. The coupling ensues via a small air volume which is located between the membranes. If a sound wave impinges the directional microphone at a specific angle of sound incidence, the sound wave reaches both microphone membranes at different points in time. The sound wave is conveyed by the membranes to the volume between the two membranes. This effects a complex interaction of both mechanically vibration-capable membranes. Depending on the angle of incidence, an amplitude and phase difference appears between the sound waves affecting the membranes, due to the delay differences. Given a symmetric incidence in which the sound wave impinges both membranes simultaneously, the sound pressures fed into the acoustic coupling are equally large, meaning they are located at equilibrium. If the vibrations are measured with a mechanism to generate an output signal, for example with ordinary microphone sensors, in this case the output signals of both microphone membranes are, in the ideal case, equally large. In contrast, they differ given an asymmetric incidence of the sound wave.

This is advantageous in that such a directional microphone exhibits a very small and compact assembly. The dimensions of the assembly are predominantly given by the size of the membranes and by the air volumes that, on the one hand, produce the connection to the sound entrance ports and, on the other hand, couple the two membranes with one another. "Acoustic coupling" means a coupling that is generated by a sound wave that forms in the air in the third air volume. A further advantage is that, due to the acoustic coupling of the sound pressures present at both sound entrance ports, membrane vibrations are generated that are dependent on the angle of sound incidence.

In a particularly advantageous embodiment of the directional microphone, an electrical layer on one of the two membranes and a backplate (counter) electrode to this electrically conductive layer form a capacitive transducer element. Such a capacitive transducer element enables an output signal to be generated from the vibration of the membrane, and has the advantage that the technology of such "capacitive microphones" can be transferred to the directional microphone.

In an advantageous embodiment, the backplate electrode is arranged between the two membranes (that are arranged parallel to one another) in which a small air gap respectively lies between one of the two membranes and the backplate electrode. To ensure the acoustic coupling of the two membranes, the backplate electrode may comprise air ducts. This has the advantage that the coupling can be adjusted with regard to its strength with the aid of the size of the air ducts.

In a particularly advantageous development, both membranes are conductively coated and, with the backplate electrode, respectively form a capacitive transducer element. Each transducer element can generate an output signal which differs in its amplitude and in the phase, dependent on the direction of incidence of an acoustic signal, from the respective other output signal. The direction of incidence can be inferred using these differences.

In a particularly advantageous embodiment, the directional microphone additionally comprises a signal processing unit and an omnidirectional microphone, by which, with the aid of the signal processing unit, the microphone signal may be used to generate the output signal of the directional microphone corresponding to a directional characteristic. The omnidirectional microphone can either be integrated in a housing with both membranes, or the omnidirectional microphone can by fashioned as an independent unit with separation from the membranes. This embodiment has the advantage that, with the microphone signal of the omnidirectional microphone, a direction-independent comparison measurement is available that, with the aid of the signal processing unit, can be combined with the output signal that is based on the vibration or one or both membranes.

The invention is also directed to a method for utilizing a hearing aid device, comprising the directional microphone described above.

Further advantageous embodiments of the invention are described below.

DESCRIPTION OF THE DRAWINGS

FIG. 1 is a cross section illustrating the schematic assembly of a directional microphone with two membranes according to an embodiment of the invention;

FIG. 2 is a graph showing a simulated frequency dependency on magnitude and phase of an output signal that results for both membranes given a sound field that occurs at an angle of 12.5°;

FIG. 3 is a graph showing a direction-dependent sensitivity distribution of an output signal of an individual membrane at 300 Hz;

FIG. 4 is a graph showing a direction-dependent sensitivity distribution of an output signal of an individual membrane at 1600 Hz; and FIG. 5 is a functional schematic diagram of a directional microphone system that comprises an omnidirectional microphone, a directional microphone with two membranes, and a signal processing unit.

DETAILED DESCRIPTION OF THE PREFERRED EMBODIMENTS

Figure 1:
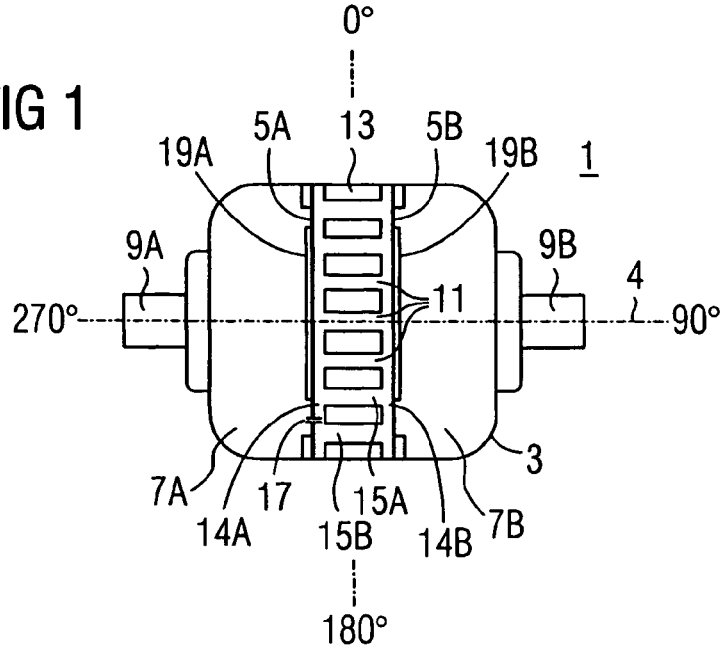
FIGS. 1 through 5 illustrate a plurality of exemplary embodiments of the invention using.

FIG. 1 shows a schematic assembly of an embodiment of a directional microphone 1 with a cylindrically formed housing 3 in the section along the cylinder axis 4. Located in the housing 3 are two membranes 5A, 5B, preferably arranged perpendicular to the cylinder axis 4, that are preferably attached air-tight to the housing 3 via mountings. The membranes 5A, 5B are in contact with air volumes 7A, 7B. If a sound wave impinges on the sound entrance ports 9A, 9B, it arrives in the air volumes 7A, 7B and effects an oscillation (vibration) of the membranes 5A, 5B, due to the pressure changed by the sound wave.

A third air volume 11 and a backplate electrode 13 are located between the two membranes 5A, 5B. The air volume 11 is comprised of two air gaps 14A, 14B that exist between the backplate electrode 13 and the two membranes 5A, 5B, as well as of air ducts 15A, 15B which infuse the backplate electrode 13. The air ducts 15A, 15B are, for example, round air channels running parallel to one another and substantially perpendicular to the membranes. The air volume 11 effects an acoustic coupling of the two membranes 5A, 5B that leads to a negative coupling since, in the case, for example, that the membrane 5A vibrates outwards due to an occurring sound field considered from the middle of the directional microphone 1, the opposite membrane 5B is moved towards the middle of the directional microphone 1 due to the negative coupling.

The membrane 5A comprises a penetration opening 17 that enables a barometric pressure equalization of the air volume 11 via the air volume 7A connected with the environment.

If, for example, a sound wave impinges the directional microphone 1 from 270°, corresponding to the indicated angle scale, the membrane 5A will initially begin to vibrate. Due to the vibration of the membrane 5A, the air volume 11 undergoes a pressure change and transfers this to the membrane 5B, such that the membrane 5B also begins to vibrate. This vibration is superimposed with the sound wave occurring in the volume 7B at a later point in time. The sound pressure of the sound wave in the volume 7B is, for its part, transferred via the vibration of the membrane 5B to the air volume 11, which in turn effects the coupling with the membrane 5A.

The acoustic-electric conversion of the vibrations of the membranes 5A, 5B can, for example, ensue with the aid of a capacitive transducer system. In such a system, a type of plate capacitor is formed from the backplate electrode 13 and an electrically conductive layer 19A, 19B on one of the membranes 5A, 5B. In such a capacitor microphone, the capacitor is charged by way of a polarization voltage. Based on the sound signals, the distance changes between the layer on the membrane 5A, 5B and the backplate electrode 13, and a capacitance change of the capacitor arises which is detected with an electronic impedance transducer and is converted into an electrical voltage. Alternatively, an electret-capacitor microphone can be used in which an electric charge is permanently stored on the membrane 5A, 5B or on the surface of the backplate electrode 13. The use of digital microphone transducer technology or plunger coil transducer technology can also be utilized for acoustic-electric conversion.

Figure 2:
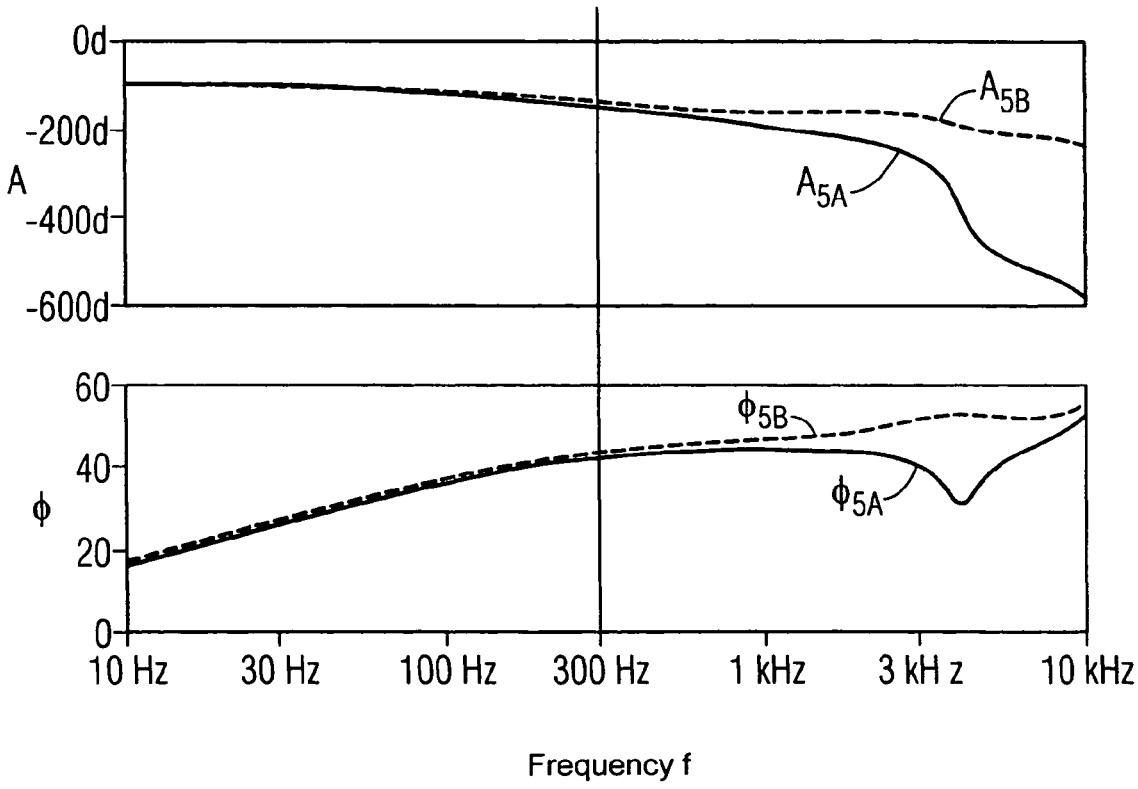

FIG. 2 reproduces a frequency dependency on amount A and phase ϕ, simulated for the membranes 5A, 5B. An angle of sound incidence of 12.5° (using the angles indicated in FIG. 1) and a distance of the microphone entrance ports of 4 mm is assumed. In the upper part of the image, the amounts $A_{5A}$, $A_{5B}$ of both membrane vibrations are mapped over the frequency f in a frequency range of 10 Hz through 10 kHz. In the lower part of the image, the output signals are shown corresponding to the curve of the phases $\phi_{5A}$, $\phi_{5B}$. Given an angle of sound incidence of 12.50, a delay difference of 2.5 μsec results for the sound wave incident on both membranes 5A, 5B. In this minimal difference, a clearly detectably difference already shows between the two microphones in amount A and phase ϕgiven a frequency of 300 Hz. With additional frequency f, the difference becomes ever more developed.

Figure 3:
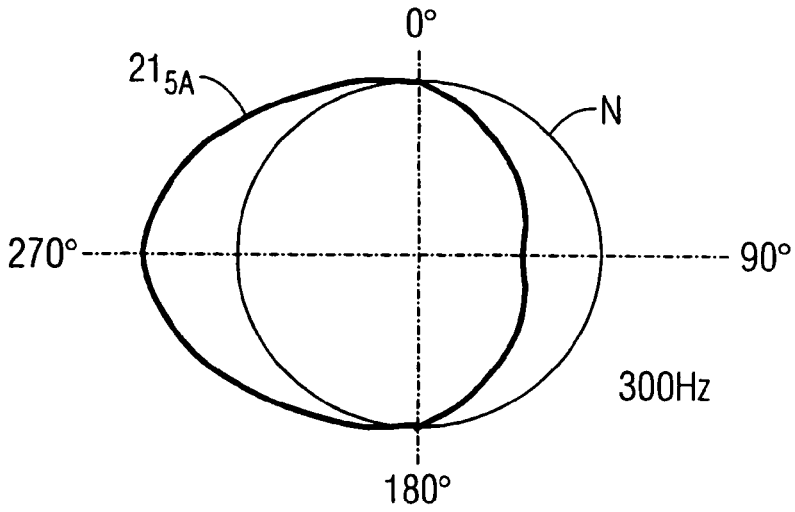

FIG. 3 shows a simulated direction-dependent sensitivity distribution $\mathbf{21}_{5A}$ of an output signal of the "left" membrane 5A at 300 Hz. This "directional characteristic" is normalized to the sensitivity given an angle of sound incidence of 0°, which is normalized to the value 1 and is clarified by the circle N. The angle graduation corresponds to that of FIG. 1. A clearly higher sensitivity on the side associated with the membrane 5A is recognizable, as well as a lower sensitivity on the other side. Additionally, there is a significant phase difference between the output signals of the two membranes 5A, 5B.

Figure 4:
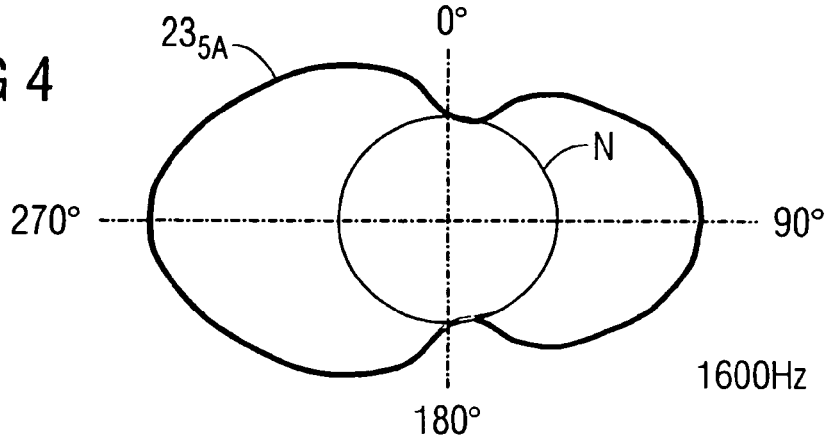

FIG. 4 shows a corresponding sensitivity distribution $\mathbf{23}_{5A}$ of an output signal of the "left" membrane 5A at 1600 Hz. The structure of this directional characteristic is dominated by two regions of increased sensitivity that are located at 90° and 270°. Likewise, the sensitivity is greater on the side associated with the membrane 5A, and significant phase differences between the output signals exist.

Figure 5:
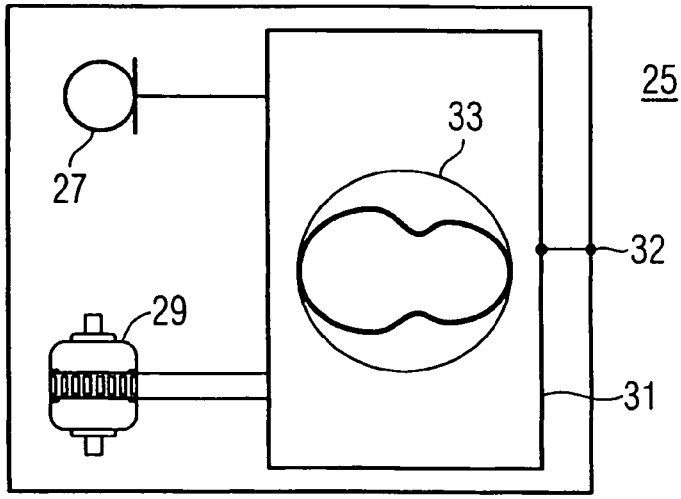

FIG. 5 shows a functional schematic of a directional microphone system 25 that comprises an omnidirectional microphone 27, a directional microphone 29 with two membranes, and a signal processing unit 31. One or both signals of the membranes of the directional microphone 29 are mixed with the signal of the omnidirectional microphone 27 in the signal processing unit 31 into a output signal present at an output 32, with which a directional characteristic 33 is associated. The signal processing unit could additionally monitor the mixing, such that the directional characteristic is adapted to the sound field.

In a simple embodiment, only one signal of a membrane (which alone represents an improvement over a gradient microphone with regard to the directional sensitivity) is used, and is possibly operated together with an omnidirectional microphone in a housing or in separate housings.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, where the elements of the present invention are implemented using software programming or software elements the invention may be implemented with any programming or scripting language such as C, C++, Java, assembler, or the like, with the various algorithms being implemented with any combination of data structures, objects, processes, routines or other programming elements. Furthermore, the present invention could employ any number of conventional techniques for electronics configuration, signal processing and/or control, data processing and the like.

The particular implementations shown and described herein are illustrative examples of the invention and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

REFERENCE LIST

| | |
|---|---|
| 1 | directional microphone |
| 3 | housing |
| 4 | cylinder axis |
| 5A, 5B | membrane |
| 6 | mounting |
| 7A, 7B | air volume |
| 9A, 9B | sound entrance port |
| 11 | air volume |
| 13 | backplate electrode |
| 14A, 14B | air gap |
| 15A, 15B | air gap |
| 15A, 15B | air channel |
| 17 | permeation opening |
| 18A, 19B | electrically conductive layer |
| A, $A_{5A}$, $A_{5B}$ | amount |
| $\phi$, $\phi_{5A}$, $\phi_{5B}$ | phase |
| F | frequency |
| $21_{5A}$, $23_{5A}$ | sensitivity distribution |
| N | circle |
| 25 | directional microphone system |
| 27 | omnidirectional microphone |
| 29 | directional microphone |
| 31 | signal processing unit |
| 33 | directional characteristic |

What is claimed is:

1. A directional microphone, comprising:

a first sound entrance port and a second sound entrance port that are spatially separate from one another;

a first air volume, a second air volume, and a third air volume;

a first and second membrane that are respectively acoustically connected via the first and second air volumes with the first and second sound entrance port, the first and second membrane being acoustically coupled with one another via the third air volume;

an output signal generator configured to generate an output signal of the directional microphone from a vibration of at least one of the first and second membrane; and wherein at least one of the first and second membranes comprises a small penetration opening for barometric pressure equalization.

2. The directional microphone according to claim 1, wherein the output signal generator comprises an electrically conductive layer on at least one of the first and second membranes.

3. The directional microphone according to claim 2, wherein the output signal generator comprises a backplate electrode at the electrically conductive layer.

4. The directional microphone according to claim 3, wherein the electrically conductive layer and the backplate electrode form a capacitive transducer element.

5. The directional microphone according to claim 3, wherein both the first and second membrane are electrically conductively coated, and together with the backplate electrode respectively form a capacitive transducer element.

6. The directional microphone according to claim 3, further comprising:

an air gap lying between one of the first and second membrane and the backplate electrode, the backplate electrode being arranged between the first and second membranes.

7. The directional microphone according to claim 3, wherein the backplate electrode comprises air ducts for acoustic coupling.

8. The directional microphone according to claim 7, wherein the air ducts are arranged running parallel to one another and perpendicular to the membranes.

9. The directional microphone according to claim 1, wherein the first and second membranes are arranged parallel to one another.

10. A hearing aid system, comprising: the directional microphone according to claim 1;

an omnidirectional microphone configured to produce an omnidirectional microphone signal; and a signal processing unit connected to the directional microphone and the omnidirectional microphone, the signal processing unit being configured to utilize the omnidirectional microphone signal and directional microphone signal to generate an output signal corresponding to a directional characteristic.

11. A method for utilizing a hearing aid device, comprising:

providing a directional microphone according to claim 1 for the hearing aid device; and generating an output signal of the directional microphone from a vibration of at least one of the first and second membrane.

12. A method for operating a directional microphone, comprising:

providing an acoustic wave at a first sound entrance port of the directional microphone;

providing the acoustic wave at a second sound entrance port of the directional microphone at a location that differs from the first sound entrance port at a later time due to a difference in distance of the acoustic wave source from the first sound entrance port and the second sound entrance port respectively;

vibrating a first membrane that is acoustically connected to the first sound entrance port via a first air volume based on the acoustic wave at the first sound entrance port;

vibrating a second membrane that is acoustically connected to the second sound entrance port via a second air volume based on the acoustic wave at the second sound entrance port;

superimposing the second membrane vibration onto the first membrane via a third air volume comprising air regions that are entirely unobstructed between the first and second membranes;

outputting a signal corresponding to the vibration of the first membrane having the superimposed second membrane vibration on it due to mechanical coupling; and performing a barometric pressure equalization via a small penetration opening in at least one of the first and second membranes.

* * * * *